US005251405A

United States Patent [19]

Clauss et al.

[11] Patent Number: 5,251,405

[45] Date of Patent: Oct. 12, 1993

[54] METHOD FOR CIRCUMFERENTIAL GRINDING OF RADIALLY NON-CIRCULAR WORKPIECES

[75] Inventors: Siegbert Clauss, Esslingen; Peter Meusburger; Stefan Brandt, both of Stuttgart; Roland Schmitz, Vaihingen; Gerhard Walz, Wendlingen, all of Fed. Rep. of Germany

[73] Assignee: Fortuna-Werke Maschinenfabrik GmbH, Fed. Rep. of Germany

[21] Appl. No.: 734,964

[22] Filed: Jul. 24, 1991

[30] Foreign Application Priority Data

Jul. 25, 1990 [DE] Fed. Rep. of Germany ..... 4023587

[51] Int. Cl.[5] ..... B24B 49/04

[52] U.S. Cl. ..... 51/165.75; 51/165.71; 51/165.91; 51/281 C

[58] Field of Search ..... 51/165.74, 165.71, 165.76, 51/165.77, 105 EC, 327, 326, 165.91, 281 C, 165 TP, 165.75

[56] References Cited

U.S. PATENT DOCUMENTS

| | | | |
|---|---|---|---|
| 3,746,956 | 7/1973 | Takegawa | 51/165 TP |
| 4,528,781 | 7/1985 | Koide et al. | 51/281 C |
| 4,621,463 | 11/1986 | Komatsu et al. | 51/281 C |
| 4,747,236 | 5/1988 | Wedeniwski | 51/281 C |
| 4,884,373 | 12/1989 | Suzuki et al. | 51/105 EC |
| 4,885,874 | 12/1989 | Wedeniwski | 51/165 |

*Primary Examiner*—Robert A. Rose

*Attorney, Agent, or Firm*—Walter A. Hackler

[57] ABSTRACT

A method serves for circumferential grinding of radially non-circular workpieces, in particular for grinding cams (15) or polygons. The workpiece is rotated about a first second axis (13) extending at an angle, preferably of 90°, relative to the first axis (18). Starting out from a raw contour, the material at the surface of the workpiece (15) is removed along spiral-shaped paths of a point of action (20), by a plurality of steps corresponding each to one rotation of the workpiece, until intermediate contours and finally a finished contour are obtained, this being achieved by rotating and/or advancing the workpiece and the grinding wheel (11) in a controlled way, in response to data records. Every time an intermediate contour is reached, a new data record is called up for the next rotation of the workpiece. One measures continuously a predetermined absolute dimension ($R_{Gist}$) of the workpiece and derives therefrom the existing deviation ($\Delta R_G$) from a given setpoint value ($R_{GSoll}$). The deviation ($\Delta R_G$) is compared (40) with threshold values and a predetermined number of steps is skipped when the actual values fall below the threshold values.

7 Claims, 5 Drawing Sheets

METHOD FOR CIRCUMFERENTIAL GRINDING OF RADIALLY NON-CIRCULAR WORKPIECES

The present invention relates to a method for circumferential grinding of radially non-circular workpieces where the workpiece is rotated about a first axis and a grinding wheel is advanced along a second axis extending at an angle, preferably of 90°, relative to the first axis and where, starting out from a raw contour, the material at the surface of the workpiece is removed along spiral-shaped paths of a point of action, by a plurality of steps corresponding each to one rotation of the workpiece, until intermediate contours and finally a finished contour are obtained, this being achieved by rotating and/or advancing the workpiece and the grinding wheel in a controlled way, in response to data records, with a new data record being called up for the next rotation of the workpiece every time an intermediate contour is reached, and by performing continuously a predetermined absolute measurement on the workpiece and deriving therefrom the existing deviation from a given setpoint value.

A method of the before-mentioned type is known from U.S. Pat. No. 4,885,874.

Circumferential grinding of radially non-circular workpieces, for example circumferential grinding of the cams of a camshaft or of polygonal sections, is effected today with the aid of numerically controlled (CNC) grinding machines. For processing the workpieces, the latter are mounted in the machine and rotated about their longitudinal axis (known as C axis) by means of a controllable workpiece rotating system. The grinding wheel is arranged on a wheel carriage that can be advanced along another axis (known as X axis) toward the rotary axis of the workpiece. The C axis and the X axis usually extend perpendicularly one relative to the other. The desired circumferential profile of the workpiece, i.e. the cam shape or the polygonal shape, are then produced by the correlated steps of rotating the workpiece about the C axis at predetermined steps and advancing the grinding wheel at the same time linearly along the X axis. These two correlated movements define, in the so-called "path mode", the workpiece profile desired at any time, whereas in the so-called "enfeed mode" another infeed motion is superimposed, corresponding to the desired material removal rate.

In order to displace the C axis and the X axis in the described manner, depending on the desired circumferential contour of the workpiece, data records are stored in the control of the grinding machine. These data records assign to each angular position of the C axis a specific linear setting of the X axis, the values of each data record being adjusted in such a way as to produce exactly the desired circumferential profile, giving regard to both the "path mode" and the "infeed mode".

Workpieces of the kind of interest for the present purpose are introduced into the process as blanks, which means that they still are considerably oversized, relative to the desired finished dimensions, which oversize has to be removed by the respective process. Considering, however, that the total oversize, i.e. the geometrical distance between the raw contour and the desired finished contour, is generally greater than the amount of material that can be removed by a single processing step, known processes are usually carried out in several steps which are performed one after the other. Normally the procedure is such that at first a number of roughing steps are carried out with a relatively high infeed rate, and that thereafter a number of finishing steps are carried out with a correspondingly smaller infeed rate, until the finished workpiece is discharged, i.e. unloaded from the workpiece holder.

As a result of this progressive grinding operation, by which the workpiece is reduced from its raw contour to the desired contour, the point of action of the grinding wheel moves along the workpiece on a spiral-shaped path which commences at the first point of engagement of the grinding wheel on the raw contour of the workpiece to be processed and which finally ends at a final point of the finished contour of the finished workpiece.

It has been known in connection with such multi-step machining operations to provide for each step, i.e. for each revolution of the workpiece, a specific data record lasting from one intermediate contour to the next intermediate contour. Usually, one stores one data record per step in the numerical control of the machine tool so that the data records can be retrieved in a time-saving way during machining of the workpiece. However, it would also be possible to calculate the necessary data records for each new machining step during the machining process. In view of the technical means available today, this would however be too time-consuming so that it is usual practice to determine all data records in advance and to store them in the control as fixed data.

Now, in practice the most various interfering influences may arise during machining of the workpiece, which may result in machining faults. A first such interfering effect may be encountered when a workpiece which is clamped by its ends, for example a long thin shaft, deflects radially as it is engaged by the grinding wheel. Another interfering factor consists in thermal variations of the lengths of the different components of the machine tool and also of the workpiece itself. Still another interfering factor results from dynamic lag errors, for example when the grinding machine has to displace great masses (wheel carriage) at relatively high speed when grinding non-circular parts. Finally, interfering influences may also result from wear of the grinding wheel, changes in position resulting from mounting and unloading processes, and the like.

The errors resulting from such interfering influences are subdivided into what is called defects of shape and dimensional errors. Defects of shape relate only to deviations from the predetermined ideal shape, without giving regard to absolute measurements, while dimensional errors relate only to the absolute dimensions of specific characteristic points of the profile produced, whereas general compliance with the predetermined shape is left out of regard.

In the case of the grinding methods that have been known heretofore, as described f or example by German journal "Werkstatt und Betrieb", 118 (1985), pages 443 to 448, the cams of a camshaft was ground using predetermined data record, whereafter the camshaft was unloaded from the grinding machine and measured at a different location. One then determined any existing defects of shape, and derived from such defects of shape of the real ground camshaft compensation values for the data records, whereafter further camshafts were ground using the corrected data records.

This conventional procedure is, however, connected with a number of disadvantages. On the one hand, the before-mentioned dimensional errors are not considered at all, and on the other hand, the before-mentioned unloading and re-mounting of the workpieces requires quite a lot of time and entails the risk of further errors.

Now, another grinding method has been known from the before-mentioned U.S. Pat. No. 4,885,874 where a non-circular workpiece (camshaft) is measured in the chucked condition in the grinding machine by means of touch probes in order to determine any dimensional errors. The known method provides that one first grinds the first cam of a camshaft, using predetermined data, one then determines any dimensional errors by means of the before-mentioned touch probes, and corrects the data records of the control of the grinding machine immediately so that thereafter all the other cams of the camshaft can be ground using the corrected values.

This method, thus, provides the essential advantage that any dimensional errors can be corrected in one and the same mounting position, at least for the other cams of the camshaft. However, a certain disadvantage remains with that method because the first cam still has to be ground with the uncorrected data record. In addition, this known method is not suitable for any non-circular workpieces which comprise only a single non-circular section. This is the case, for example, with polygonal shafts or polygonal connections with an outer or inner polygon.

SUMMARY OF THE INVENTION

Now, it is the object of the present invention to improve a method of the before-mentioned type in such a way that machining errors are detected from the very first contact of the grinding wheel with the workpiece, and are monitored and evaluated for controlling the machine tool so that the ground workpiece are true to size throughout.

This object is achieved according to the invention by the fact that the deviation is compared with threshold values and that a predetermined number of steps is skipped when the actual values fall below the threshold values.

The object underlying the invention is fully solved in this manner.

For, contrary to the method of the prior art, the method according to the invention makes use of a controlled process where the dimensions of the workpiece are monitored by a continuous measuring procedure and by comparing the measurements with a setpoint value. If the setpoint value envisaged for the respective machine operation or machining step has been reached, machining is stopped with the consequence that the workpiece produced always has the exact desired dimensions.

The method according to the invention, therefore, is the first to enable non-circular workpieces to be ground true to dimension already by the very first machining operation. And if workpieces, such as camshafts, are to be ground to identical non-circular profiles at different positions, it is also possible with the aid of the method according to the invention to achieve a dimensionally true profile already in the first machining area, i.e. for the first cam.

A preferred further development of the method according to the invention provides that a first plurality of roughing steps and a second plurality of finishing steps are performed and all further roughing steps are skipped when the actual values fall below the threshold value during a roughing step.

This feature provides the advantage that it is ensured, when machining a workpiece by several phases (roughing/finishing), that the moment when an intermediate setpoint value is reached is detected during one of the several machining phases in order to instruct the machine immediately to terminate this machining phase.

Correspondingly, when a plurality of finishing steps are provided, followed by an unloading step, all further finishing steps can be skipped when the actual values fall below the threshold value during a finishing step.

This makes the method according to the invention suited also for subsequent machining phases, or for machining workpieces which are to be processed by a single machining mode only.

Further, it is preferred according to the present invention if for some of the plurality of steps a finite feeding increment is preset and if different feeding increments are selected for machining steps following each other over time. Specifically, the feeding increment may decrease for steps following each other over time.

This feature provides the advantage that, depending on the particular circumferential profile, the particular material or type of grinding wheel, the oversize to be removed can be fixed individually for different machining steps following each other in time.

In order to enable the before-mentioned predetermined number of steps to be skipped, as provided for by the invention, two alternatives would suggest themselves, for example.

The first variant of one embodiment of the invention provides that the plurality of steps is greater than the number required for the particular workpiece in the most unfavorable of all cases, and when the actual values fall below the threshold value, all steps that have not been executed at this point are skipped.

As an alternative, it is also possible to make use of a loop by providing a plurality of steps the last of which consist in the repetition of one particular step which repetition will be discontinued as soon as the actual value falls below the threshold value.

While the first of the two abovementioned alternatives provides the advantage that each processing step to be executed can be set individually, the second alternative may under certain circumstances simplify the control.

Other advantages of the invention will appear from the specification and the attached drawing.

It is understood that the features that have been described before and will be explained hereafter may be used not only in the described combinations, but also in any other combination, or individually, without leaving the scope and intent of the present invention.

BRIEF DESCRIPTION OF THE DRAWINGS

Certain embodiments of the invention will now be described in more detail with reference to the drawing in which.

DETAILED DESCRIPTION

Figure 1:
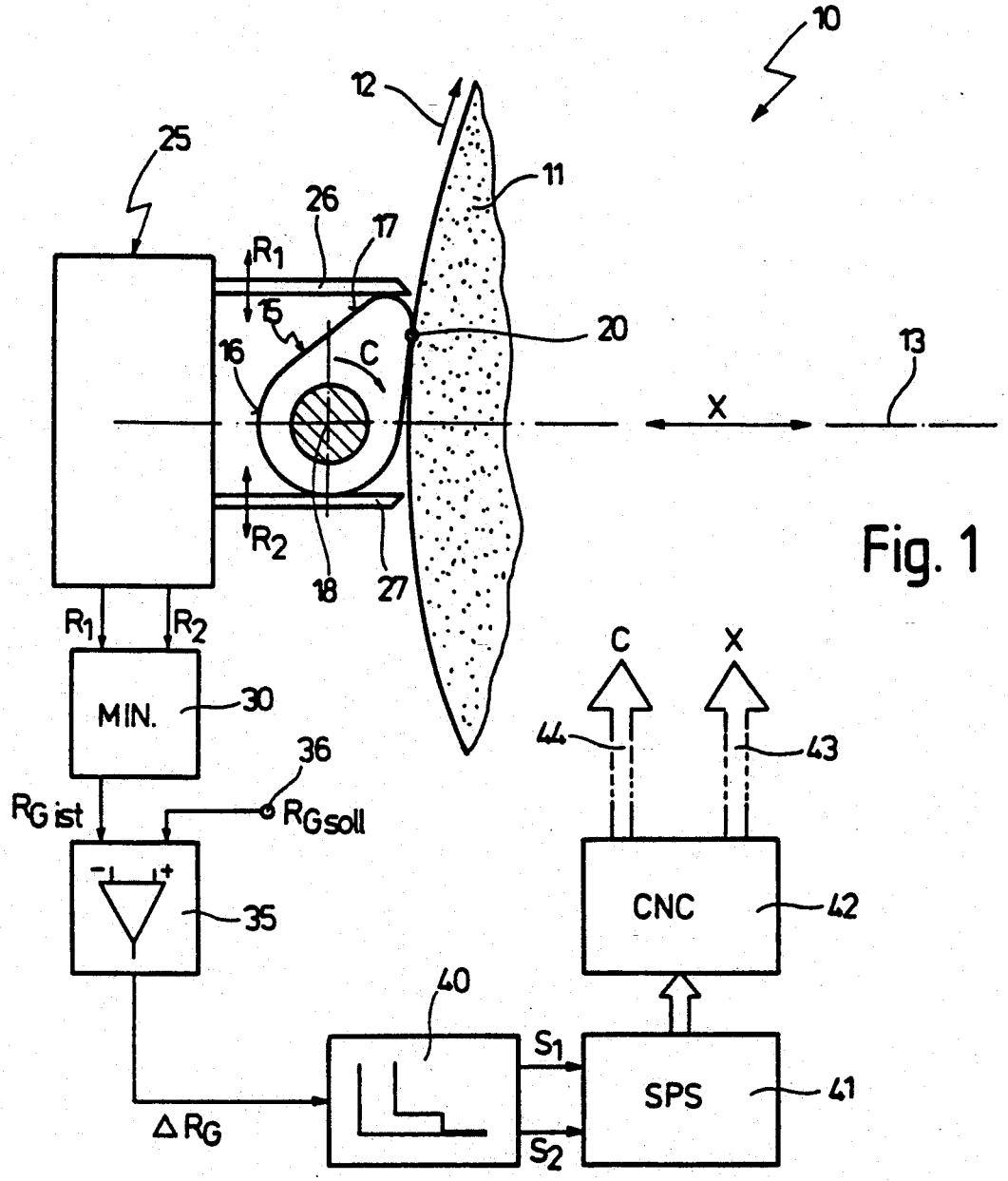
FIG. 1 shows a highly diagrammatic illustration of a grinding machine intended to carry out the method according to the invention.

In FIG. 1, a grinding machine is illustrated very diagrammatically at 10. The grinding machine 10 comprises a grinding wheel 11 revolving about an axis, not shown in FIG. 1, in a direction indicated by 12. The grinding wheel 11 can be displaced along a linear first axis 13, known as X axis. The grinding wheel 11 is arranged for this purpose on a wheel carriage not shown in FIG. 1, which can be displaced in the conventional manner in the direction of the first axis 13. The displacement is likewise not indicated in FIG. 1, for the sake of clarity.

A cam 15 is illustrated in FIG. I as an example for a radially non-circular workpiece of the type that can be processed with the aid of the method according to the invention. The cam 15 displays, in the conventional manner, a basic circular section 16, i.e. an area of constant radius, and in addition a raised section 17, i.e. an area where the cam 15 displays a radially non-circular shape.

The cam 15 is part of a camshaft which is mounted in the grinding machine 10 along a second axis 18, chucked by its longitudinal axis. The second axis 18 is a rotary axis, as indicated by an arrow in FIG. 1, and in practice is called C axis.

During machining of the cam 15 by the grinding wheel 11, the latter engages the periphery of the cam 15 at a point of action 20. The term "point of action" defines of course a line-shaped area of contact between the grinding wheel 11 and the cam 15, perpendicular to the drawing plane of FIG. 1.

The second axis 18 usually is perpendicular to the first axis 13, although the two axes may of course also enclose between them a finite angle of any other amount.

In order to produce the desired circumferential profile, for example of the cam 15, the cam 15 is rotated about the second axis 18 at predetermined angular steps, and the grinding wheel 11 simultaneously is reciprocated along the first axis 13, in a predetermined way. The resulting displacement of the point of action 20 describes the desired profile, and at the same time the required infeed is set.

The grinding machine 10 as illustrated in FIG. 1 corresponds insofar to the prior art discussed above.

The grinding machine 10 is further equipped with a length-measuring device 25, which is provided in stationary arrangement near the cam 15 and which operates during the machining operation. The length-measuring device 25 comprises two measuring jaws 26, 27, which contact the cam 15 from above and from below, as illustrated in FIG. 1. The measuring jaws 26, 27 are adapted to follow the shape of the cam as indicated by the double arrows in FIG. 1, measuring during this movement the actual radius R. In the position of the cam 15 illustrated in FIG. 1, for example, the upper measuring jaw measures a value $R_1$ which almost corresponds to the maximum elevation of the cam 15, while the lower measuring jaw 27 measures a value $R_2$ equal to the basecircle radius $R_G$ of the cam 15 in the base-circle segment 16.

The measured values so determined by the measuring jaws 26, 27 are transmitted from outputs of the length-measuring device 25 to a minimum selection stage 30. The minimum selection stage 30 is adapted to output only the smaller of the two measured values $R_1$ or $R_2$. Given the fact that the base-circle segment 16 extends over a circumferential angle of more than 180°, at least one of the measuring jaws 26 or 27 is at any time in contact with the base-circle segment 16, which is at the same time the area having the minimum radius.

Consequently, the value $R_{GiSt}$ at the minimum selection stage 30 is always that value which corresponds to the actual value of the base-circle radius $R_G$ present at any time.

A comparator stage 35 arranged downstream of the minimum selection stage 30 now compares this value $R_{Gist}$ with a setpoint value $R_{GSOll}$ which is supplied to the comparator 35 from a control via a terminal 36. The comparator 35 determines the deviation of the actual value $R_{Gist}$ from the setpoint value $R_{GSOll}$, and the resulting deviation is described in FIG. 1 by ΔRG. The deviation ΔRG is now transmitted to a threshold value stage 40 arranged downstream of the comparator stage 35.

Figure 2:
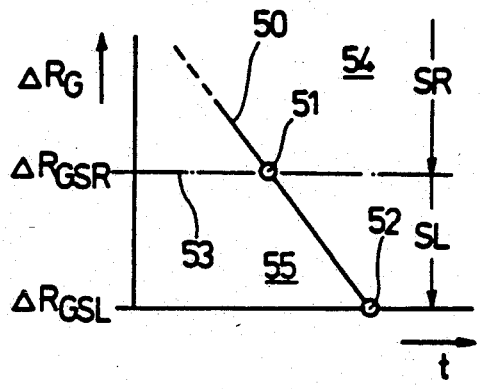
FIG. 2 shows a diagram illustrating a first control system employed in connection with the present method.

The threshold value stage 40 is illustrated more fully in FIG. 2.

FIG. 2 illustrates the deviation $\uparrow R_G$ over the time t during a machining process.

As will be readily appreciated, the deviation $\Delta R_G$ of the actual value $R_{Gist}$ from the setpoint value $R_{GSOll}$ of the desired finished contour decreases as the machining operation advances, i.e. over the time t, as is illustrated in FIG. 2 by the line 50. In the course of the machining process, the line 50 reaches at first a point 51 and then a point 52. The point 52 lies on a separating line 53 which defines the transition from a roughing area 54 to a finishing area 55. The roughing steps are defined in FIG. 2 and in the following figures by SR, the finishing steps by SL.

In order to distinguish between the areas 54 and 55, a threshold value $\Delta R_{GSR}$ has been stored in the comparator 40, while the end of the roughing area 55 is characterized by a threshold value $\Delta R_{GSL}$ preferably equal to zero.

Now, when the line 50 representing the deviation $\Delta R_G$ reaches the first point 51, which means that the end of the roughing area 54 has been reached, a first signal $S_1$ is emitted by the threshold value stage 40, while at the end of the finishing area 55, i.e. when the point 52 is reached, a corresponding signal $S_2$ is generated.

The signals $S_1$ and $S_2$ are supplied from the output of the threshold value stage 40 to an input of a programmable control 41, which in its turn controls the numerical control device 42 of the grinding machine 10. The numerical control device 42 is connected to data outputs 43 and 44 for the motion units of the X axis, i.e. the first axis 13, and the C axis, i.e. the second axis 18.

The effect of the signals $S_1$ and $S_2$ on the control unit 42 will be described in more detail further below, with reference to FIGS. 5 to 9.

Figure 3:
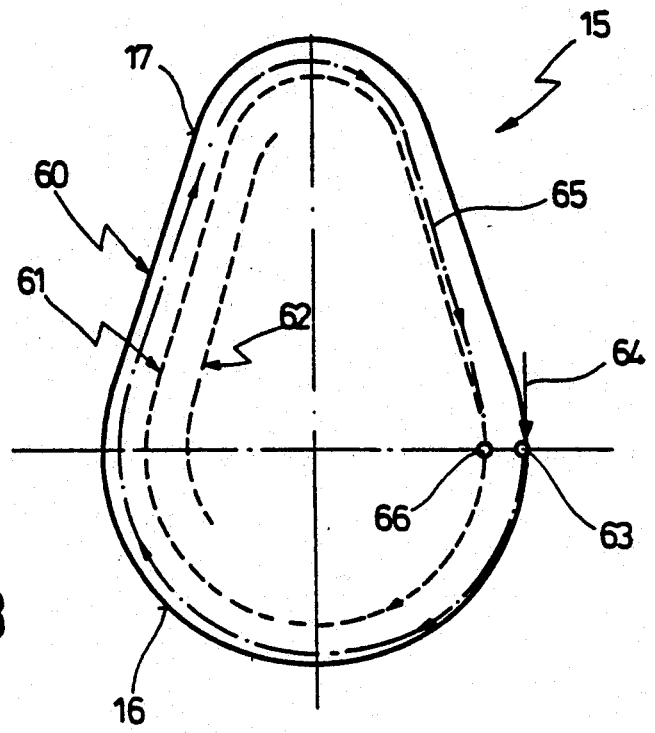
FIG. 3 shows a side view of a cam of a camshaft as illustration of a workpiece of the type that can be machined with advantage by the method according to the invention.

FIG. 3 shows once more a side view of the cam 15, in enlarged scale, the cam 15 being illustrated in the raw condition before machining, so that its circumference presents a raw contour 60. Reference numeral 61 describes an intermediate contour which is produced as an intermediate result during the grinding process, while 62 finally describes a finished contour, i.e. the contour of a finished cam having the desired dimensions.

Figure 4:
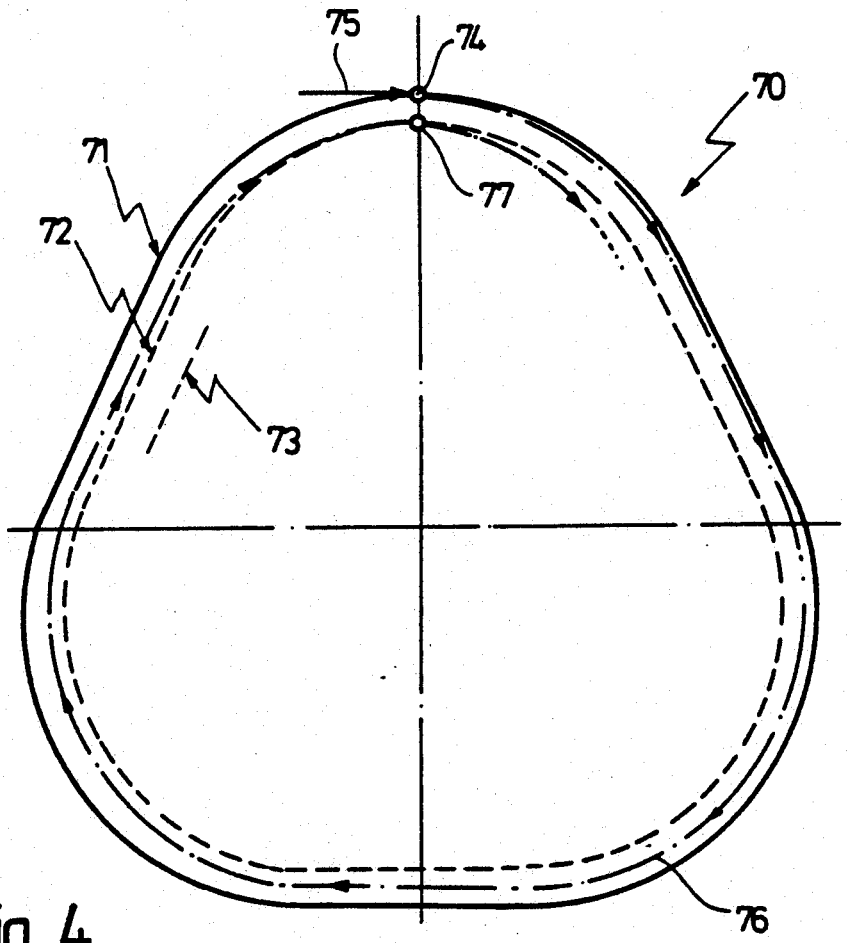
FIG. 4 shows a representation similar to that of FIG. 3, but for the case of a polygonal profile.

It goes without saying that the representation of FIG. 3, and that of the following FIG. 4 as well, are to be regarded as being of a highly diagrammatical nature and that the illustrated dimensions are exaggerated for greater clarity. It is further understood that there are a plurality of intermediate contours 61 between the raw contour 60 and the finished contour 62, although only one of such intermediate contours 61 has been illustrated, again for the sake of greater clarity.

Reference numeral 63 in FIG. 3 defines a starting point, i.e. the point of first contact of the grinding wheel with the illustrated blank, as symbolized by arrow 64. Beginning at the starting point 63, the actual point of action, which is indicated by 20 in FIG. 2, follows a spiral-shaped path 65 which, as infeed progresses, gets more and more remote from the raw contour 60 and approaches more and more the first intermediate contour 61, until it finally reaches an intermediate point 66. The intermediate point 66 has a radial distance from the starting point 63 which corresponds to the oversize between the raw contour 60 and the first intermediate contour 65.

After such spiral-shaped path has been repeated several times, the finished contour 62 is finally reached.

For machining a cam 15, one usually performs at first a number of the described steps (spiral-shaped paths 65) in roughing operation, with relatively high infeed increments, and then a number of additional steps in finishing operation, with correspondingly smaller infeed increments.

FIG. 4 illustrates the respective relationships for the case of a polygonal profile 70 of the type used, for example, for torque connections between shafts and hubs, or spindles and tools.

In FIG. 4, a raw contour is defined by 71, an intermediate contour by 72 and a finished contour by 73. The grinding wheel commences its machining operation at the starting point 74, as indicated by arrow 75, and then follows again a spiral-shaped path 76 until it reaches an intermediate point 77 on the intermediate contour 72.

Apart from the different shape of the workpiece, the relationships are identical to those illustrated in FIG. 3.

Figure 5:
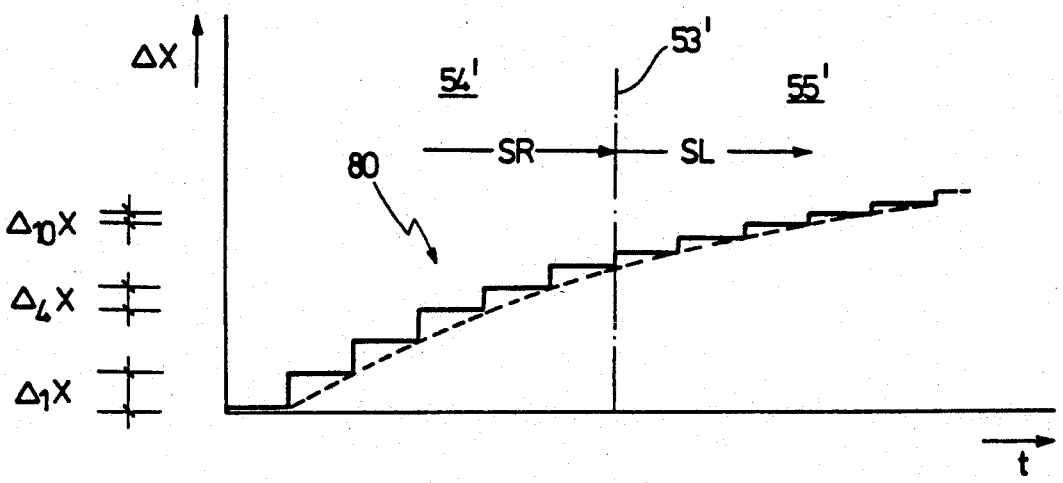
FIG. 5 shows another diagram illustrating the method according to the invention.

FIG. 5 shows a plot illustrating the relationship between the infeed increment $\Delta X$ adjusted for subsequent steps and the time t, during a machining operation.

It will be readily seen that the curve 80 in FIG. 5 has a stepped shape, which means that the infeed increment is varied by steps from one processing step to the next, i.e. from one revolution of the workpiece to the next. "Stepped" is, however, intended to mean in this connection that the infeed increment can be adjusted during a processing operation, i.e. during one revolution of a workpiece, only insofar as the infeed increment desired for the particular processing step can be adjusted during a relatively short period of time, i.e. over a very small angle of rotation of the workpiece. In connection with cam grinding operations it has been known; for example, to set the entire infeed by displacing the grinding wheel 11 while the latter is in engagement with the base-circle segment 16 of the cam 15.

On the other hand, it is however also possible, as indicated by dashed lines in FIG. 5, to arrange for a continuous or quasi-continuous infeed, in which case the respective infeed increments have been adjusted to the coordinates of the profile to be produced by continuous calculation, over the full circumference of the workpiece.

In FIG. 5, reference numerals 54' and 55' indicate again roughing areas SR and finishing areas SL. Further, it can be seen that the infeed increment $\Delta X$ set for the different machining steps is not constant by amount. Preferably, the desired infeed increment is set in such a way that it gets smaller for later machining operations, and is of course considerably greater for the roughing steps than for the finishing steps. FIG. 5 shows by way of example an infeed increment $\Delta_1 X$ for the first machining step, i.e. the first revolution of the workpiece, a smaller infeed increment a $\Delta_4 X$ for the forth machining step, still in the roughing area SR, and finally a substantially smaller infeed increment $\Delta_{10} X$, which already belongs to a machining step in the finishing area SL.

Figure 6:
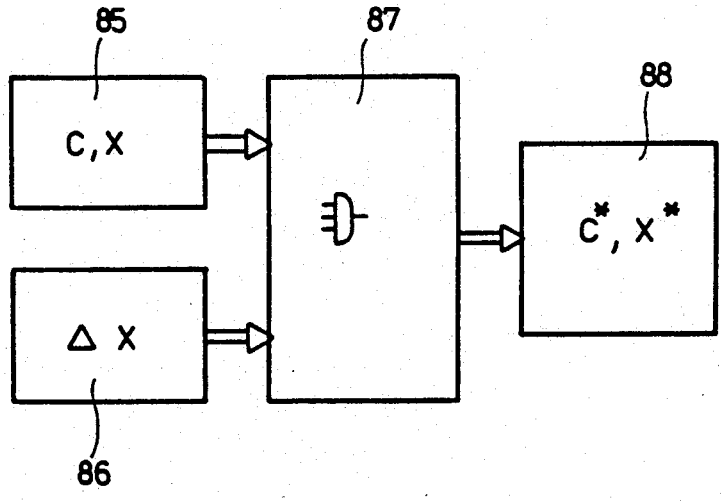
FIG. 6 shows a block diagram illustrating the modification of data records.

FIG. 6 illustrates diagrammatically the way in which data records are produced for successive machining steps.

Reference numeral 85 in FIG. 6 defines a profile memory containing what is called a base profile. This base profile may be stored in the form of cartesian coordinates, polar coordinates, or the coordinates of the two axes 13, 18. Between these diverse coordinates, coordinate transformations can be carried out as required, using conventional methods.

If in the case of FIG. 6 the profile memory 65 contains the base profile in the form of the coordinates C and X of the two axes 13, 18 of the grinding machine 10, then an infeed pattern $\Delta X$ may be stored in an infeed store 86 for successive machining operations.

A logic circuit 87 now enables the base profiles stored in the profile memory 85 to be re-calculated so as to create a second profile memory 88 containing modified profiles $C^*$, $X^*$. In the simplest of all cases, this is effected taking the C coordinates from the first profile memory 85 unchanged, while the X coordinates are varied additively by the desired infeed increment $\Delta X$ for the respective machining step.

At the end of the process symbolized in FIG. 6, the further profile memory 88 contains as many data records as steps are desired for the respective grinding process.

Figure 7:
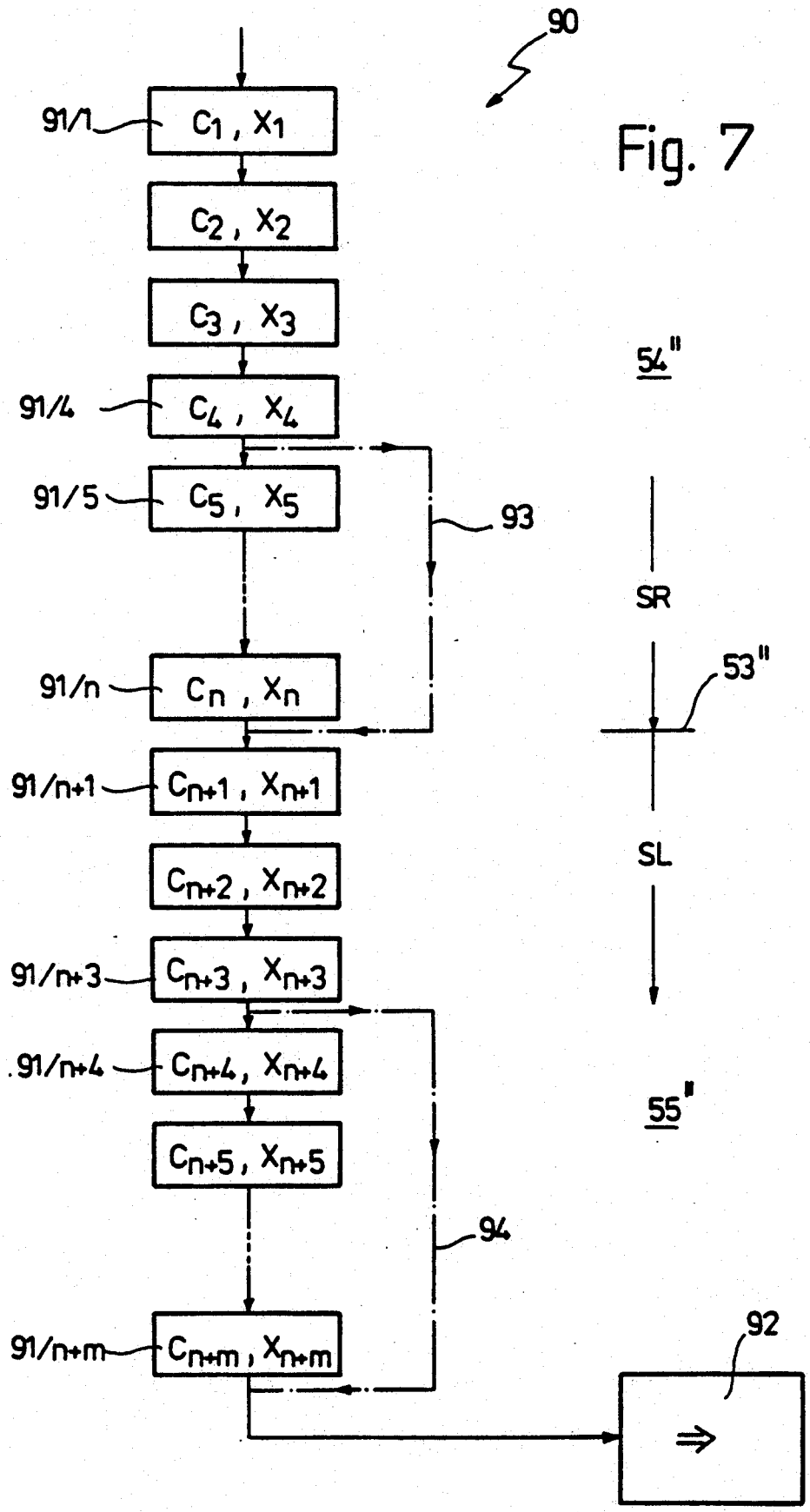
FIG. 7 shows a flow diagram, in further illustration of the method according to the invention.

FIG. 7 now shows a flow diagram 90 illustrating the method according to the invention.

In FIG. 90, the blocks 91/1. . . , 91/4, 91/5. . . , 91/n correspond to the different machining steps or data records C, X in the roughing area 54'', while the blocks 91/n+1. . . , 91/n+3, 91/n+4. . . , 91/n+m define data records for the machining steps in the finishing area 55''.

At the end of the finishing area 95'' one recognizes an additional block 92 which symbolizes the unloading step of the workpiece from the grinding machine 10.

In the case of the variant of the method according to the invention, as illustrated in FIG. 7, the numbers n and m of the roughing and finishing steps, respectively, are selected to be greater than the number of machining steps that would be required for the respective workpiece in the worst of all cases. This means in other words that if all of the n roughing steps and all of the m finishing steps were carried out, the produced workpiece would, even under the most unfavorable conditions, have dimensions smaller than the desired dimensions.

The method according to the invention now provides, however, that the absolute dimensions of the workpiece are measured continuously and monitored following each machining step in the manner illustrated in FIG. 1.

If it is now found that after a given number of roughing steps or finishing steps the final dimension preset for the respective area 53'' or 55'' has been reached, then the signals $S_1$ or $S_2$, respectively, are generated.

In the example illustrated in FIG. 7, the threshold value stage 40 may have detected, after the fourth roughing step 91/4, that the deviation $\Delta RG$ from the final dimension of the finished contour had reached, or dropped below, a predetermined threshold value $\Delta R_{GSR}$, as had been indicated in FIG. 2 by the point 51. The threshold-value stage 40 then generated the signal $S_1$.

The signal $S_1$ has the effect, in the programmable control 41 and the subsequent CNC control unit 42, that a jump occurs in the flow diagram 90 of FIG. 7, which results in the condition that once the fourth roughing step 91/4 is completed, the process sequence is switched on directly to the end of the roughing area 51'', which means that the other roughing steps 91/5. . . , 91/n originally envisaged are skipped, and that the machine proceeds immediately with the finishing steps 91/n+1 . . .

Assuming now that it is detected, after the third finishing step 91/n+3, that the deviation $\Delta RG$ of the base-circle radius differs from the setpoint dimension $R_{GSL}$, which finished contour only by the threshold value $\uparrow R_{GSL}$, which is preferably equal to 0, then the threshold value stage 40 generates the second signal $S_2$ with the result that a second jump 94—illustrated in FIG. 7—occurs, switching the process on to the end of the finishing area 55''. The further finishing steps 91/n+4. . . , 91/n+m are skipped, and the finished workpiece is immediately unloaded.

Figure 8:
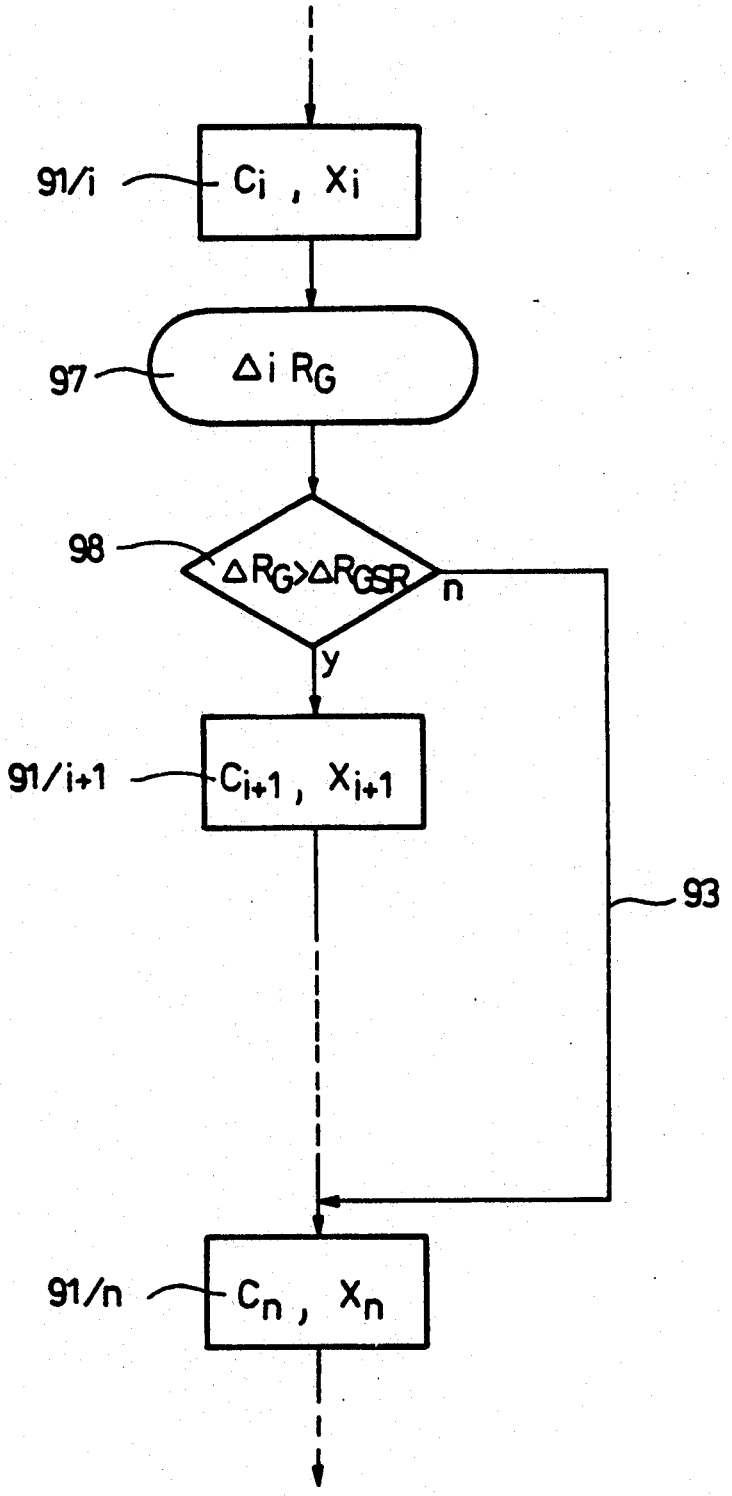
FIG. 8 shows a detail of the flow diagram of FIG. 7, illustrating additional details of the method according to the invention.

The way in which the jumps 93 and 94 are produced is illustrated once more in FIG. 8 by way of an enlarged detail of the roughing area 54'' of the flow diagram 90.

It can be seen that after a roughing step 91/i has been finished using the data record $C_1$, $X_1$ in block 97, the actual deviation $\Delta_1 R_G$ from the setpoint value of the base-circle radius $R_{GSOll}$ is fetched from the output of the comparator 35.

A decision block 98 now compares whether or not this deviation $\Delta_1 R_G$ is still greater than the setpoint value $\Delta R_{GSR}$. If so, the machine proceeds with the following roughing step 91/89i+1. If not, i.e. if the threshold value $\Delta R_{GSR}$ has already been reached, then the machine is caused to perform the jump 93 to the first finishing step 91/n.

It goes without saying that the flow diagram 90 illustrated in FIGS. 7 and 8 represents only one example of a plurality of possibilities. For example, instead of providing a very great number of blocks 91, greater than the number maximally required, it would also be possible to provide a smaller, limited number of blocks arranged at their end in the manner of a loop permitting any desired number of repetitions of the last step. This last step would then have to be given a relatively small infeed increment and would have to be carried out as often as necessary until the comparator 35, with its subsequent threshold-value stage 40, would detect that a given threshold value has been reached, in order to suppress any further repetitions.

What is claimed is:

1. A method of grinding workpieces along a non-cylindrical peripheral surface thereof, the method comprising the steps of:

chucking said workpiece within chucking means, said chucking means having first drive means;

rotating said workpiece in subsequent revolutions about a first axis under the action of said first drive means;

displacing a rotating grinding wheel along a second axis intersecting said workpiece surface under the action of second drive means, said second axis extending at an angle with respect to said first axis, for grinding said workpiece surface during said subsequent revolutions along a non-cylindrical contour;

measuring a predetermined dimension of said workpiece surface for obtaining a dimension value during grinding of said workpiece surface;

wherein said steps of rotating and displacing are performed simultaneously under numerical control and comprise the sub-steps of:

loading a data memory of said numerical control with a predetermined number of data sets, each data set corresponding to control signals for actuating said first and said second drive means during one revolution of said workpiece;

advancing said grinding wheel for bringing same into engagement with said workpiece surface;

initiating a grinding control program calling a first data set from said memory;

in a first grinding step displacing said grinding wheel and simultaneously rotating said workpiece under control of said first data set during a first revolution of said workpiece;

further working said grinding control program by stepwise calling subsequent data sets;

in further grinding steps further displacing said grinding wheel and simultaneously rotating said workpiece under control of said subsequent data sets during subsequent revolutions of said workpiece;

comparing said dimension value with a predetermined dimension value during said subsequent revolutions for generating a deviation value;

comparing said deviation value with a predetermined threshold value; and jumping within said control program over any remaining subsequent data sets when said deviation value falls below said predetermined threshold value.

2. The method of claim 1, wherein a first number of roughing grinding steps and a subsequent second number of finishing grinding steps are provided and said step of jumping comprises jumping over all further roughing grinding steps when said deviation value falls below said threshold value during a roughing grinding step.

3. The method of claim 1, wherein a number of finishing grinding steps are provided, followed by a workpiece unloading step, and said step of jumping comprises jumping over all further finishing grinding steps when said deviation value falls below said threshold value during a finishing grinding step.

4. The method of claim 1, wherein during some of the number of grinding steps said grinding wheel is further advanced towards said workpiece surface by a finite feeding increment, different feeding increments being selected for preselected grinding steps.

5. The method of claim 4, wherein said feeding increment decreases for grinding steps following each other over time.

6. The method of claim 1, wherein for a particular grinding operation a number of grinding steps is provided in said control program, said number being greater than a theoretical number required for said particular grinding operation under worst case aspects.

7. The method of claim 1, wherein a number of grinding steps is provided, the last of which consisting in a continuous repetition of one particular preceding grinding step, said repetition being discontinued as soon as said deviation value falls below said threshold value.

* * * * *